US009961978B2

(12) United States Patent
Liao

(10) Patent No.: US 9,961,978 B2
(45) Date of Patent: May 8, 2018

(54) MECHANISM AND METHOD FOR EASILY REPLACING ZIPPER OF ZIPPERED HARDSIDE LUGGAGE

(71) Applicant: GUANGZHOU WINTIMES ALUMINUM PRODUCTS CO., LTD., Guangzhou, Guangdong (CN)

(72) Inventor: Xiwei Liao, Guangdong (CN)

(73) Assignee: GUANGZHOU WINTIMES ALUMINUM PRODUCTS CO., LTD., Guangzhou (CN)

( * ) Notice: Subject to any disclaimer, the term of this patent is extended or adjusted under 35 U.S.C. 154(b) by 235 days.

(21) Appl. No.: 14/905,831

(22) PCT Filed: Jul. 15, 2014

(86) PCT No.: PCT/CN2014/082234
§ 371 (c)(1),
(2) Date: Jan. 18, 2016

(87) PCT Pub. No.: WO2015/007203
PCT Pub. Date: Jan. 22, 2015

(65) Prior Publication Data

US 2016/0157574 A1 Jun. 9, 2016

(30) Foreign Application Priority Data

Jul. 17, 2013 (CN) ..... 2013 1 0304136

(51) Int. Cl.
*A45C 13/10* (2006.01)
*A44B 19/44* (2006.01)
(Continued)

(52) U.S. Cl.
CPC ..... *A45C 13/103* (2013.01); *A45C 5/03* (2013.01); *A44B 19/34* (2013.01); *A44B 19/40* (2013.01);
(Continued)

(58) Field of Classification Search
CPC ..... A44B 19/34; A44B 19/36; A44B 19/40; A44B 19/403; A44B 19/406; A44B 19/28;
(Continued)

(56) References Cited

U.S. PATENT DOCUMENTS 2,114,683 A 4/1938 Kates
5,396,685 A * 3/1995 Wilk ..... A44B 19/38 24/388
(Continued)

FOREIGN PATENT DOCUMENTS

CN 202077767 U 12/2011

OTHER PUBLICATIONS

International Search Report of PCT Patent Application No. PCT/CN2014/082234 dated Oct. 20, 2014.

*Primary Examiner* — Jason L Vaughan

(57) ABSTRACT

A mechanism and method for easily replacing a zipper of a zippered hardside luggage, wherein one side of a zipper is fixed to an upper case body by an upper zipper fastener, and the other side of the zipper is fixed to a lower case body by a lower zipper fastener; the upper zipper fastener and the lower zipper fastener have a respective notch; a removable notch fastener is arranged at the joint between the upper case body and the lower case body at the notch; and the replacement method comprises: firstly removing the notch fastener, pulling out the old zipper from the notches of the upper zipper fastener and the lower zipper fastener, then passing a new zipper through the notches of the upper zipper fastener and the lower zipper fastener, and finally mounting the notch fastener.

5 Claims, 4 Drawing Sheets

(51) Int. Cl.
*A44B 19/34* (2006.01)
*A44B 19/40* (2006.01)
*A45C 5/03* (2006.01)

(52) U.S. Cl.
CPC ..... *A44B 19/44* (2013.01); *A45C 2005/037* (2013.01); *Y10T 29/4973* (2015.01); *Y10T 29/49782* (2015.01)

(58) Field of Classification Search
CPC ... A44B 19/44; A44B 19/46; Y10T 29/49782; Y10T 29/4973; Y10T 29/49785; Y10T 29/49721
See application file for complete search history.

(56) References Cited

U.S. PATENT DOCUMENTS 5,745,960 A * 5/1998 Dishner ..... A44B 19/00 24/381
5,813,094 A * 9/1998 Perez, II ..... A44B 19/00 24/381
6,378,176 B1 * 4/2002 Scherer ..... A44B 19/38 24/433
6,877,192 B2 * 4/2005 Tominaga ..... A44B 19/12 24/381
8,083,040 B2 * 12/2011 Chiang ..... A44B 19/34 190/119

* cited by examiner

MECHANISM AND METHOD FOR EASILY REPLACING ZIPPER OF ZIPPERED HARDSIDE LUGGAGE

TECHNICAL FIELD

The present invention relates to the field of luggage, in particular to a mechanism and method for easily replacing a zipper of a zippered hardside luggage.

BACKGROUND ART

In the current industry of luggage, a zipper used in a zippered hardside luggage is a personalized easily-worn component, and needs to be often replaced according to the customer's requirements for different colors or due to the damage during the use. In the existing process for manufacturing a luggage, the fixation of a zipper is generally achieved, as shown in FIGS. 1 and 2, by fixing a zipper 1 to a soft rubber strip 2 (or leather) using a needle and thread and then adhering the soft rubber strip to a case body 3 and a case cover 4 using glue. However, in the actual use of a luggage, the luggage manufactured by the process mentioned above generally has the problems:

(1) when a zipper of a luggage needs to be replaced, it is required to spend a lot of labor and time to remove the glue on the case body and the case cover for adhering the old zipper and then fix a new zipper with glue, by which the replacement efficiency is very low and the operation is tedious;

(2) when replacing a zipper, the soft rubber strip (or leather) for fixing the zipper also needs to be replaced at the same time, so that the replacement cost of zipper is high, which is not good for the control of the manufacturing cost of luggage; and (3) the zipper is adhered to the case body and the case cover using glue, by which the fixed effect is poor and the service life is also short.

SUMMARY OF THE INVENTION

An objective of the present invention is, in order to overcome the disadvantage in the art, to provide a mechanism for easily replacing a zipper of a zippered hardside luggage, which is simple and stable in structure and convenient in operation.

Another objective of the present invention is to provide a method for easily replacing a zipper of a zippered hardside luggage using the above-mentioned mechanism.

The technical solution of the present invention is: a mechanism for easily replacing a zipper of a zippered hardside luggage, wherein one side of the zipper is fixed to an upper case body by an upper zipper fastener, and the other side of the zipper is fixed to the lower case body by a lower zipper fastener; the upper zipper fastener and the lower zipper fastener have a respective notch; and a removable notch fastener is arranged at the joint between the upper case body and the lower case body at the notch.

Said notch fastener is fixed to the upper case body or the lower case body by way of fixing with a rivet or a screw.

Said notch fastener is a flat plate with the middle part protruding upward, and during installation, the upward protruding part of the notch fastener is embedded in the notches on the upper zipper fastener and the lower zipper fastener, and the lower part of the notch fastener is fixedly connected to the lower case body.

Said upper zipper fastener and lower zipper fastener are respectively an aluminum frame with a notch, the aluminum frame having a shape the same as the opening shape of the upper case body or the lower case body.

A through-groove is provided on the side where said upper zipper fastener is connected to the zipper (according to practical requirements, the through-groove may have a circular, square or another shape of section), and the zipper is embedded in the through-groove by a rubber strip. The upper zipper fastener has an extension plate which is located at the back side of the through-groove and fixedly connected to the upper case body by a rivet.

Said lower zipper fastener has a shape of section symmetrical to that of the upper zipper fastener, i.e., the upper zipper fastener and the lower zipper fastener are arranged as a symmetrical structure on two sides of the zipper.

The present invention implements a method for easily replacing a zipper of a zippered hardside luggage by the above-mentioned mechanism, comprising: when the zipper is to be replaced, firstly removing the notch fastener, and pulling out the old zipper from the notches of the upper zipper fastener and the lower zipper fastener to remove the zipper; then passing a new zipper through the notches, so that the zipper is fixed between the upper zipper fastener and the lower zipper fastener; and finally mounting the notch fastener, so as to seal and fix the zipper to prevent the zipper from displacement.

With respect to the prior art, the present invention has the beneficial effects:

For this mechanism for easily replacing a zipper used in a zippered hardside luggage, as compared with a traditional zippered hardside luggage, the zipper fixed structure is simple and stable, and when replacing a zipper, the zipper can be rapidly replaced by only removing the notch fastener, with simple and convenient operation and high replacement efficiency.

During the use of this mechanism for easily replacing a zipper, the fastener for fixing a zipper can be repeatedly used after replacing the zipper, which is good for the control of the manufacturing cost of luggage.

In this mechanism for easily replacing a zipper, the zipper fastener (comprising an upper zipper fastener and a lower zipper fastener) adopts a fixing manner using an aluminium profile combined with a rivet, with reliable structure and long service life.

DETAILED DESCRIPTION OF THE EMBODIMENTS

The present invention will be further described below in conjunction with embodiments and the accompanying drawings. However, the embodiment of the present invention is not limited thereto.

Embodiments

Figure 1:
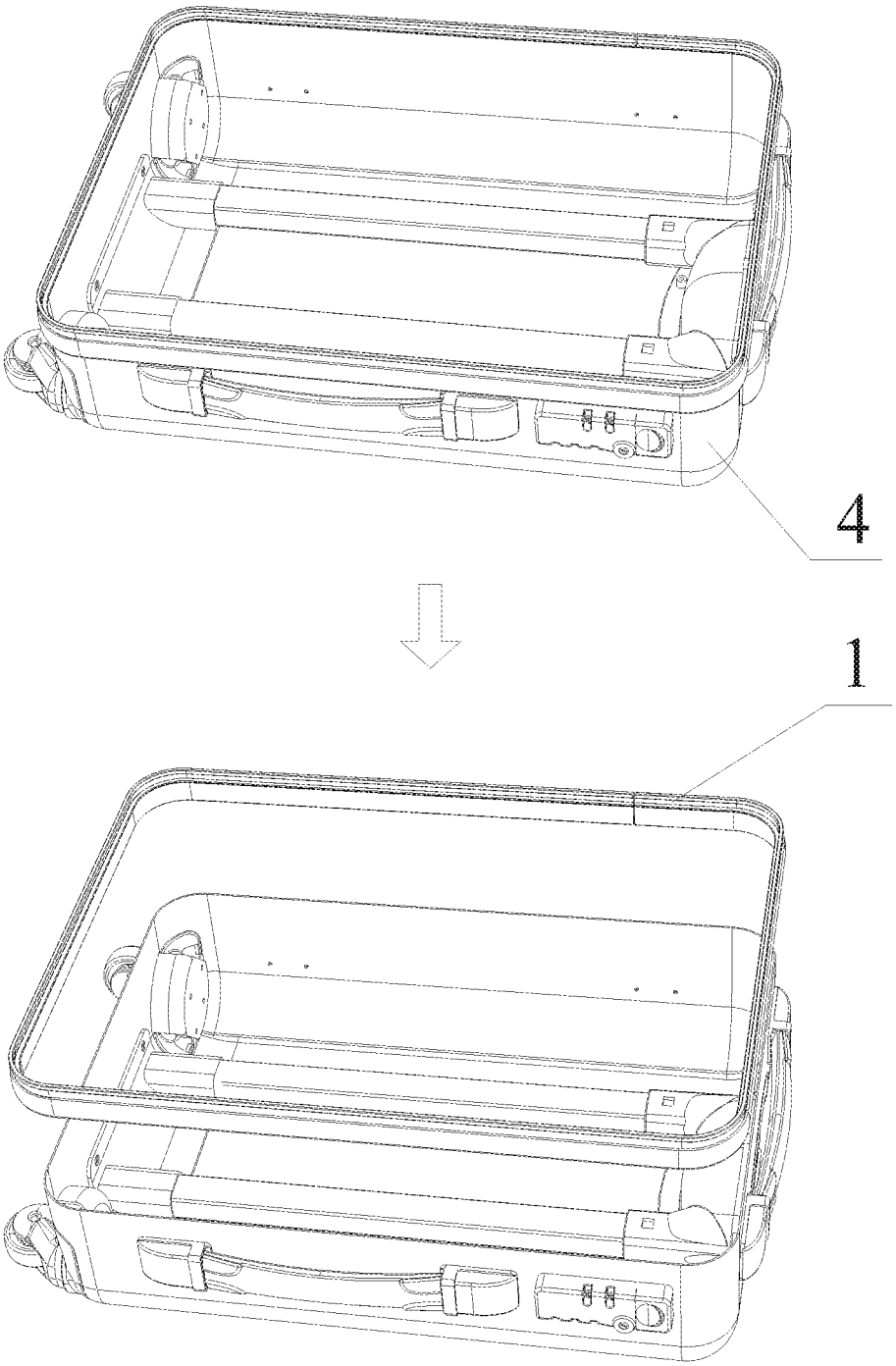
FIG. 1 is a schematic diagram of a traditional zipper replacement process.
Figure 2:
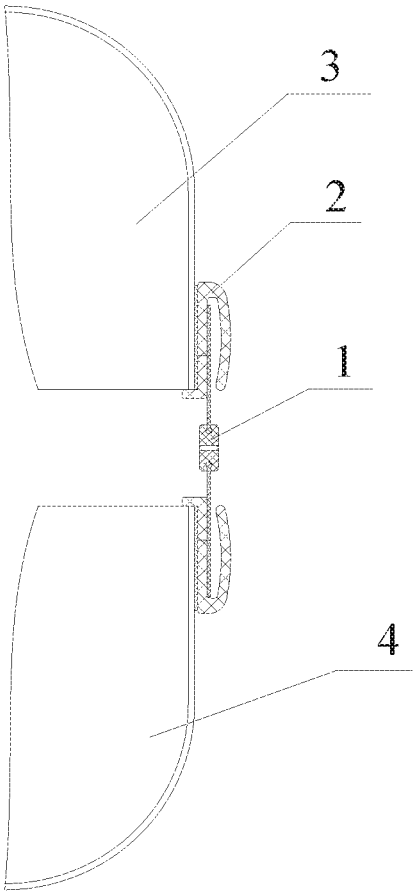
FIG. 2 is a schematic diagram of a section structure after fixing a traditional zipper.
Figure 3:
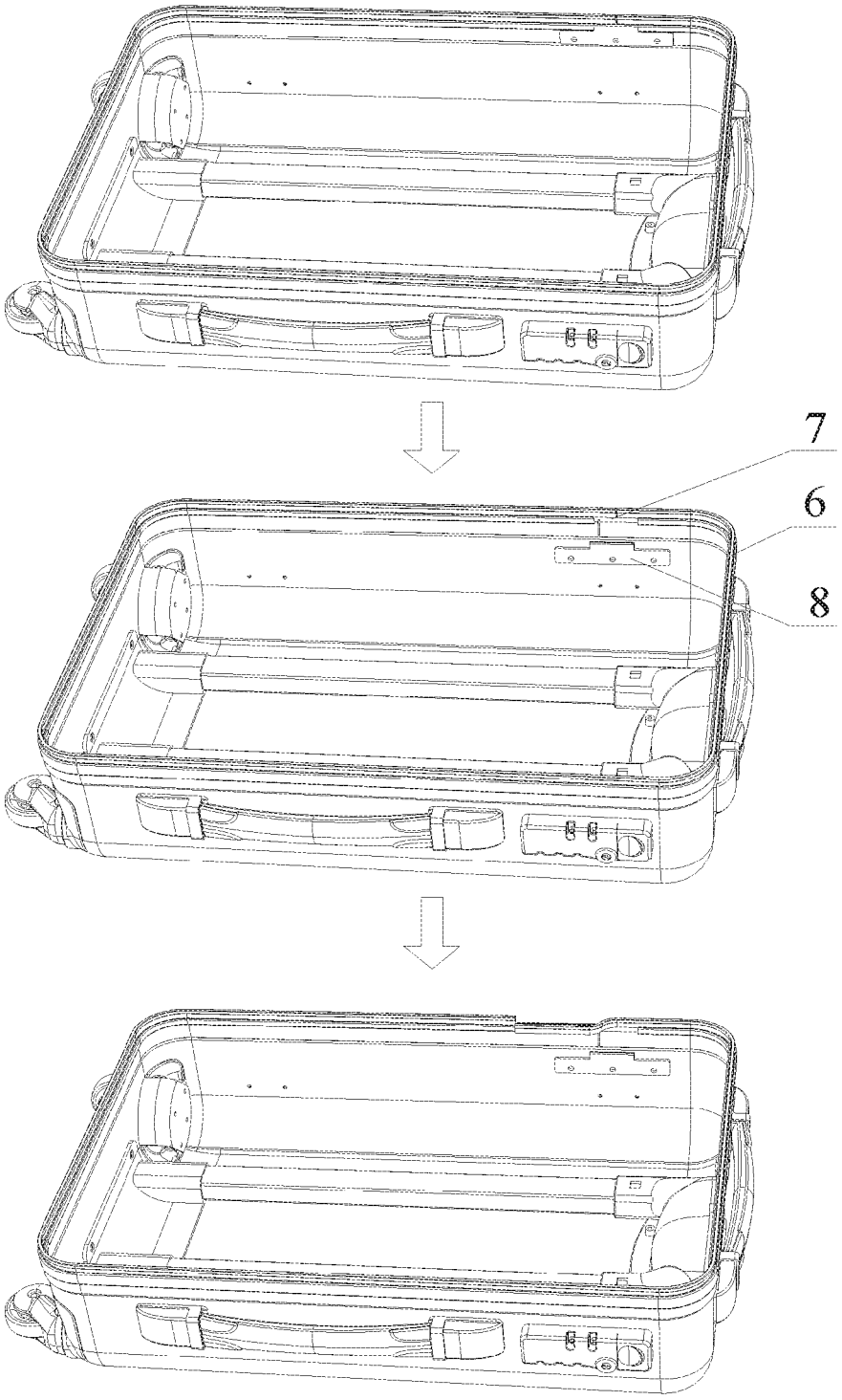
FIG. 3 is a schematic diagram of a process for replacing the zipper on the lower case body after using this mechanism for easily replacing a zipper.
Figure 4:
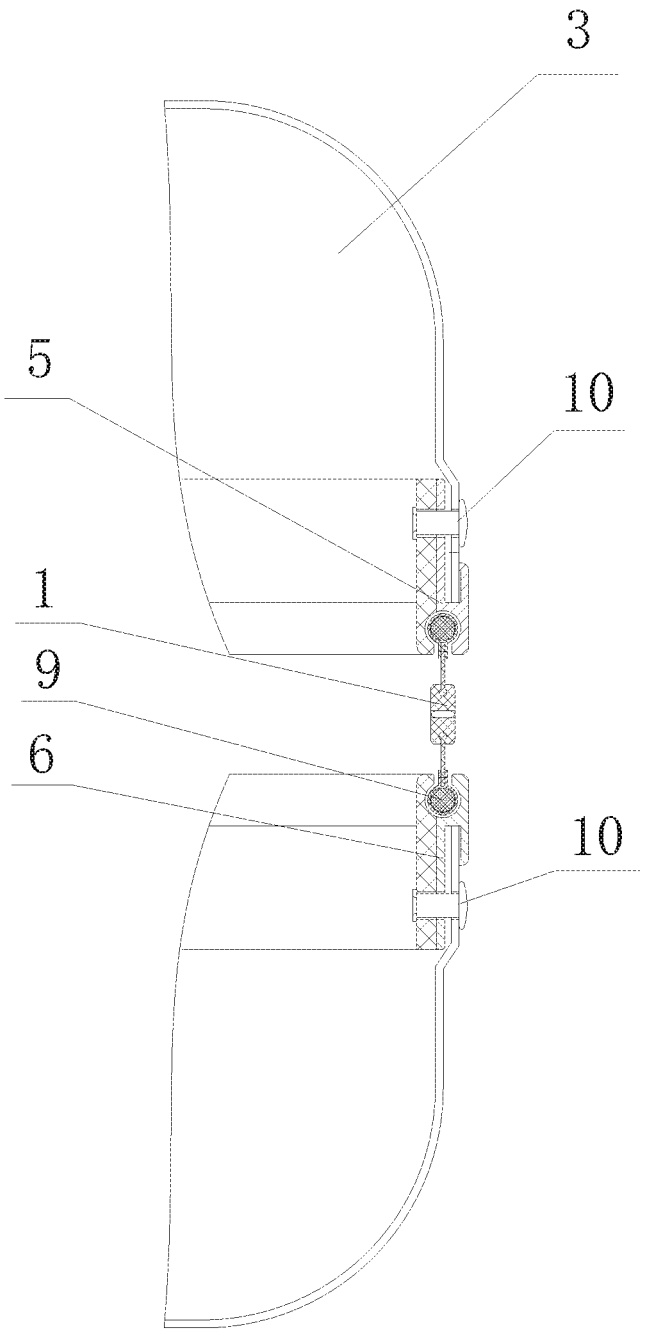
FIG. 4 is a schematic diagram of a section structure after fixing a traditional zipper after using this mechanism for easily replacing a zipper.

In a mechanism for easily replacing a zipper of a zippered hardside luggage of this embodiment, as shown in FIG. 4, one side of a zipper 1 is fixed to an upper case body 3 by an upper zipper fastener 5, and the other side of the zipper is fixed to a lower case body 4 by a lower zipper fastener 6; the upper zipper fastener and the lower zipper fastener have a respective notch; and a removable notch fastener is arranged at the joint between the upper case body and the lower case body at the notch. FIG. 3 shows a structure of the lower case body, the lower zipper fastener 6 has a notch 7, and a removable notch fastener 8 is arranged on the lower case body at the notch. The notch fastener can be fixed to the lower case body by way of fixing with a rivet or a screw.

In this embodiment, the notch fastener is a flat plate with the middle part protruding upward, and during installation, the upward protruding part of the notch fastener is embedded in the notches on the upper zipper fastener and the lower zipper fastener, and the lower part of the notch fastener is fixedly connected to the lower case body.

The upper zipper fastener and lower zipper fastener are respectively an aluminum frame with a notch, the aluminum frame having a shape the same as the opening shape of the upper case body or the lower case body.

As shown in FIG. 4, a through-groove is provided on the side where said upper zipper fastener is connected to the zipper (according to practical requirements, the through-groove may have a circular, square or another shape of section), and the zipper is embedded in the through-groove by a rubber strip 9; the upper zipper fastener has an extension plate which is located at the back side of the through-groove and fixedly connected to the upper case body by a rivet 10; and the lower zipper fastener has a shape of section symmetrical to that of the upper zipper fastener, i.e., the upper zipper fastener and the lower zipper fastener are arranged as a symmetrical structure on two sides of the zipper.

This embodiment can implement a method for easily replacing a zipper of a zippered hardside luggage by the above-mentioned mechanism, comprising: when the zipper is to be replaced, as shown in FIG. 3, firstly removing the notch fastener, and pulling out the old zipper from the notches of the upper zipper fastener and the lower zipper fastener to remove the zipper; then passing a new zipper through the notches, so that the zipper is fixed between the upper zipper fastener and the lower zipper fastener; and finally mounting the notch fastener, so as to seal and fix the zipper to prevent the zipper from displacement.

As described above, in order to implement the present invention in a better way, the above embodiment is merely a preferred embodiment of the present invention, and is not used to limit the implementation range of the present invention, i.e., all the equivalent variations and modifications made according to the content of the present invention are covered by the scope of protection of the present invention.

What is claimed is:

1. A method for easily replacing a zipper of a zippered hardside luggage, wherein one side of the zipper is fixed to an upper case body of the luggage by an upper zipper fastener, and the other side of the zipper is fixed to a lower case body by a lower zipper fastener, wherein the upper zipper fastener and the lower zipper fastener have a respective notch, and a removable notch fastener is arranged at the joint between the upper case body and the lower case body at the notch, the method comprising:

firstly removing the notch fastener, and pulling out the old zipper from the notches of the upper zipper fastener and the lower zipper fastener to remove the zipper; then passing a new zipper through the notches, so that the zipper is fixed between the upper zipper fastener and the lower zipper fastener; and finally mounting the notch fastener, so as to seal and fix the zipper.

2. The method according to claim 1, wherein the notch fastener is fixed to the upper case body or the lower case body by way of fixing with a rivet or a screw.

3. The method according to claim 2, wherein the notch fastener is a flat plate with the middle part protruding upward, and during installation, the upward protruding part of the notch fastener is embedded in the notches on the upper zipper fastener and the lower zipper fastener, and the lower part of the notch fastener is fixedly connected to the lower case body.

4. The method according to claim 1, wherein the upper zipper fastener and lower zipper fastener are respectively an aluminum frame with a notch, the aluminum frame having a shape the same as the opening shape of the upper case body or the lower case body.

5. The method according to claim 1, wherein a through-groove is provided on the side where the upper zipper fastener is connected to the zipper, and the zipper is embedded in the through-groove by a rubber strip; the upper zipper fastener has an extension plate which is located at the back side of the through-groove and fixedly connected to the upper case body by a rivet; and the lower zipper fastener has a shape of section symmetrical to that of the upper zipper fastener.

* * * * *